US005234253A

United States Patent [19]

LaPointe et al.

[11] Patent Number: 5,234,253

[45] Date of Patent: Aug. 10, 1993

[54] MOUNTING APPARATUS FOR A MODULAR SOFA ASSEMBLY

[75] Inventors: Larry P. LaPointe, Temperance; Scott A. Harmon, Monroe, both of Mich.

[73] Assignee: La-Z-Boy Chair Co., Monroe, Mich.

[21] Appl. No.: 686,581

[22] Filed: Apr. 17, 1991

Related U.S. Application Data

[63] Continuation-in-part of Ser. No. 647,017, Feb. 1, 1991.

[51] Int. Cl.[5] ..... A47C 15/00

[52] U.S. Cl. ..... 297/248; 297/85; 248/503.1; 248/501

[58] Field of Search ..... 297/433, 434, 436, DIG. 7, 297/232, 248, 249, 85; 248/503.1, 501

[56] References Cited

U.S. PATENT DOCUMENTS

| | | | |
|---|---|---|---|
| 27,645 | 3/1860 | McGregor . | |
| 78,304 | 5/1868 | Martin . | |
| 1,248,931 | 12/1917 | Schuman . | |
| 1,335,842 | 4/1920 | Lambert | 248/501 |
| 3,103,381 | 9/1963 | Schliephacke | 297/84 |
| 3,550,952 | 12/1970 | Ferguson . | |
| 3,640,569 | 2/1972 | Young | 297/248 |
| 3,841,701 | 10/1974 | Sullivan | 297/249 X |
| 4,043,591 | 8/1977 | Lehmann | 297/248 |
| 4,114,947 | 9/1978 | Nelson | 248/503.1 X |
| 4,311,337 | 1/1982 | Brunn | 297/249 |
| 4,367,895 | 1/1983 | Pacitti et al. | 297/85 |
| 4,395,071 | 7/1983 | Laird | 297/440 |
| 4,410,213 | 10/1983 | Samson | 297/84 |
| 4,570,996 | 2/1986 | Rogers, Jr. | 297/85 |
| 4,595,164 | 6/1986 | Froutzis et al. | 248/503.1 X |
| 4,669,778 | 6/1987 | Rogers, Jr. | 297/85 |
| 4,740,031 | 4/1988 | Rogers, Jr. | 297/85 |
| 4,848,839 | 7/1989 | Galardo | 297/440 |
| 4,848,843 | 7/1989 | Gibbs | 297/440 |
| 4,915,444 | 4/1990 | Rogers, Jr. | 297/68 |

FOREIGN PATENT DOCUMENTS

| | | |
|---|---|---|
| 0667245 | 2/1952 | United Kingdom . |
| 0724365 | 2/1955 | United Kingdom . |
| 0827904 | 2/1960 | United Kingdom . |
| 0831582 | 3/1960 | United Kingdom . |

*Primary Examiner*—Kenneth J. Dorner
*Assistant Examiner*—Milton Nelson, Jr.
*Attorney, Agent, or Firm*—Harness, Dickey & Pierce

[57] ABSTRACT

A mounting apparatus for securing a plurality of independent seating sections together to form a modular sofa assembly. Each of the independent seating sections has lower front and rear end portions which include front and rear cross bars, respectively. A first elongated frame rail secures to each of the rear cross bars when the independent seating sections are placed closely adjacent each other in a side-by-side configuration. A second elongated frame rail similarly attaches to the front cross bars of each chair seating section when the seating section are positioned closely adjacent each other in a side-by-side configuration. The first and second elongated frame rails are removably secured to the cross bars preferably via threaded screws and can therefore be attached quickly and easily if the sofa is to be disassembled and moved. The apparatus thus greatly facilitates the shipping and handling of independent seating sections which are intended to be coupled together to form a modular sofa by enabling each seating section to be shipped separately and then removably coupled together via the first and second elongated frame rails.

The first and second elongated frame rails each include a plurality of elongated apertures which significantly serve to introduce a degree of adjustability into the mounting apparatus to enable it to secure seating sections comprising varying thicknesses of fabric and padding in a side-by-side arrangement while maintaining a desired spacing between sections

6 Claims, 10 Drawing Sheets

332
339
364a
364
310
350
368
366
356
362
326
300
310
306
320
334
312
314
330
304a
314
304
312
324
318
304a
312
336
314
328
302
332
314
312
322
308
316

FIG 11
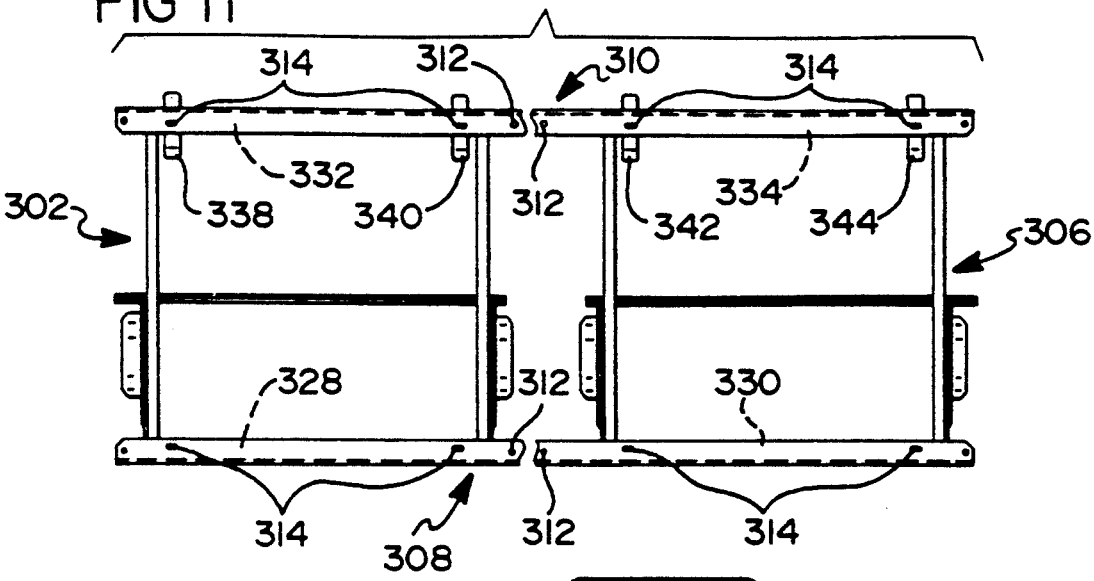
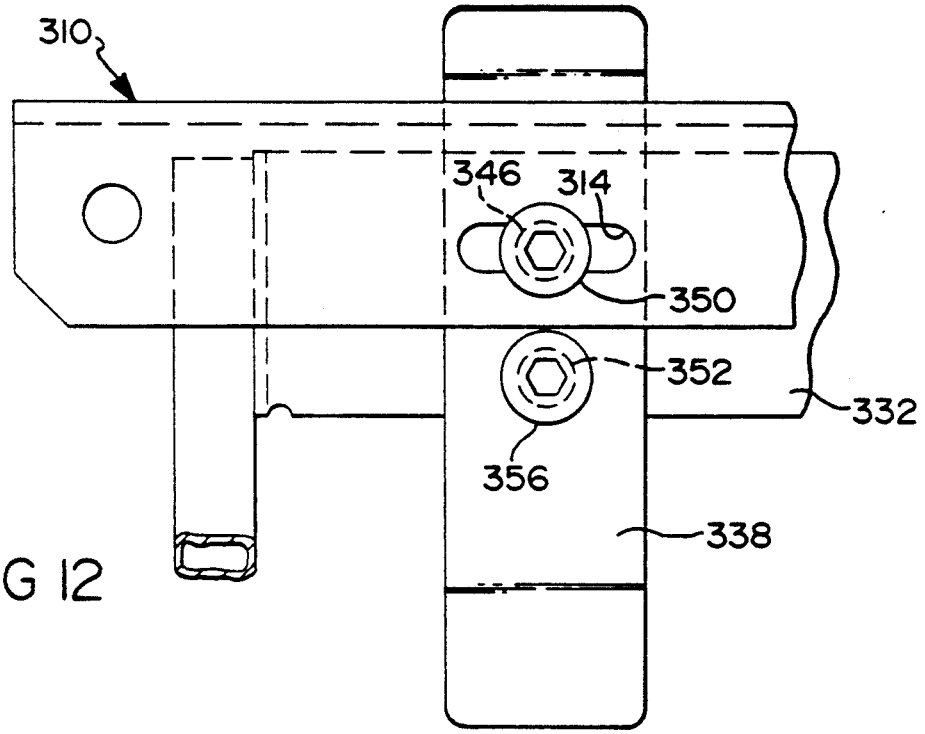
FIG 12
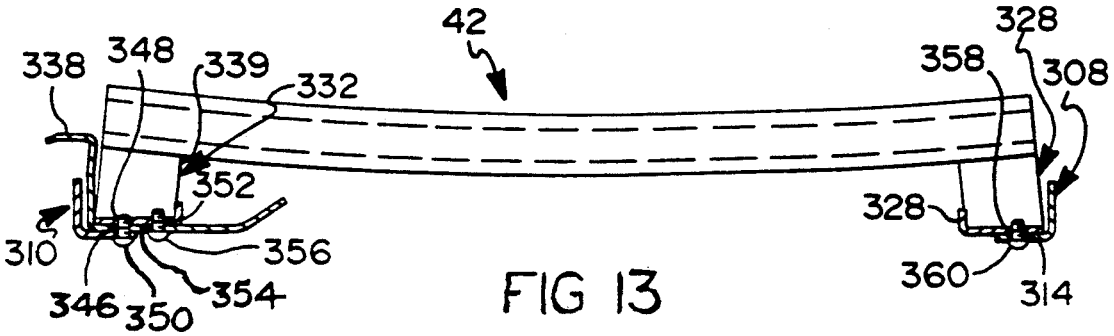
FIG 13

MOUNTING APPARATUS FOR A MODULAR SOFA ASSEMBLY

CROSS-REFERENCE TO RELATED APPLICATION

The present invention is a continuation-in-part of U.S. patent application Ser. No. 647,017, filed Feb. 1, 1991.

BACKGROUND FOR THE INVENTION

1. Technical Field

The present invention relates to furniture and, more particularly, to a mounting apparatus for removably securing a plurality of independent seating sections together in a side-by-side configuration in modular fashion to form a loveseat or sofa.

2. Discussion

Present day sofas now often incorporate one or more seating sections which function as recliners to provide a significant degree of added comfort when compared with many conventional sofas incorporating a single fixed seating arrangement. Such sofa assemblies incorporating one or more recliner seating sections enable the owner to "customize" a sofa assembly to fit her/his specific needs and lifestyle.

With sofa assemblies as described above, it has heretofore been necessary to secure the recliner section(s) of the sofa together with the remaining seating section(s) via use of a permanent frame, usually constructed integrally with the various seating sections at the factory. Accordingly, when the sofa assembly is shipped it must be shipped as one single, relatively large structure.

While the permanent frame has proved to provide good structural strength to the sofa assembly, it would be desirable to provide removable frame-like apparatus to secure the various sections of a modular sofa assembly together after the assembly has reached its destination. This would significantly ease the shipping and handling of such sofa assemblies as the various components thereof could be shipped and handled independently. At the destination, the ability to individually handle the components of the sofa assembly would contribute to much easier handling of the sofa assembly when transporting it, for example, within hallways and through doorways of rooms in a home, apartment or even an office. By being able to handle individual sections of a sofa assembly independently, the entire sofa assembly is capable of being handled and transported through such areas where the completely assembled sofa assembly might be too large and cumbersome to handle or transport.

It would further be desirable if such a frame-like mounting apparatus as described above incorporated some means for enabling the modular sections of the sofa assembly to be adjusted somewhat to compensate for slightly varying thicknesses of fabric and padding. The need for allowing some adjustability in a frame-like mounting apparatus as described above is particularly acute when one or more recliner chair sections are included to form the modular sofa assembly. The recliner sections must be able to recline freely with a minimum amount of friction from adjacent seating sections, and yet the clearance between the recliner sections and other sections of the sofa assembly must not be so great as to allow unnecessary gap clearance between adjacent seating sections of the sofa assembly.

Another significant advantage of a frame-like mounting apparatus as described above would be the flexibility in changing the configuration of the sofa assembly as the needs of the owner change. For example, if the sofa assembly was originally purchased with three sections, the owner could at a later time eliminate the center section and reinstall the two other sections on shorter frame rails to achieve a loveseat configuration. Accordingly, there would be no need for the owner to order an entire new sofa assembly comprising only two sections if the owner desired to utilize the sofa in a location with space restrictions or for other reasons.

It is therefore a principal object of the present invention to provide a mounting apparatus for a modular sofa assembly which may be removably secured to the various seating sections of the sofa assembly at a factory or at the destination where the sofa assembly is to be installed.

It is still a further object of the present invention to provide a mounting apparatus which may be secured to various sections of a modular sofa assembly quickly, easily and without any special tools.

It is yet another object of the present invention to provide a mounting apparatus which incorporates means for adjustably positioning adjacent seating sections of a modular sofa assembly thereby compensate for varying thicknesses in fabric, cushioning, etc. of the various seating sections.

It is still another object of the present invention to provide a mounting apparatus for a modular sofa assembly which enables a particular seating section, for a example, a fixed seating section to be detached from the apparatus and substituted with another seating section, for example, a reclining seating section.

It is yet another object of the present invention to provide a mounting apparatus which may be easily and conveniently shipped and handled together with independent seating sections to which the apparatus is ultimately to be secured.

SUMMARY OF THE INVENTION

The above and other objects of the present invention are accomplished by a mounting apparatus in accordance with the preferred embodiments of the present invention. The mounting apparatus generally comprises first and second elongated frame rails which are adapted to be removably secured to portions of independent seating sections to secure the seating sections together in a removably fixed modular configuration to form a sofa assembly.

The frame rails of the present invention can be quickly, easily and conveniently attached to portions of the independent seating sections at a factory or at a destination, for example at the distributor of the sofa assembly or at the home of the owner of the sofa assembly. Accordingly, various seating sections of the sofa assembly are capable of being quickly and easily assembled at the manufacturer's dealership/distributor or even by retailers of the manufacturer's furniture. The removable nature of the frame rails further enables particular sections of the sofa assembly to be removed and substituted with other suitable seating sections. Accordingly, the owner of the sofa assembly is afforded the ability to "customize" his/her sofa assembly to suit his/her specific needs and lifestyle.

The mounting apparatus of the present invention further greatly eases the shipping and handling of the components which when in assembled form comprise a modular sofa assembly. This added ease and handling in transportation, in some instances, may even enable "oversized" sofa assemblies to be constructed within a particular room of a home of the owner, which oversized sofa assembly would otherwise not be adapted to be handled and moved through hallways and door areas of the home.

DESCRIPTION OF THE DRAWINGS

FIG. 11 is a plan view of an undersurface of two independent seating sections showing the seating sections alignably positioned within the frame rails;

FIG. 12 is an enlarged fragmentary view of a portion of FIG. 11 showing the elongated nature of one of the openings within the frame rail in the manner in which the frame rail is secured to the mounting/stop bracket of the mounting rail;

FIG. 13 is a side elevational view of one of the channel tracks of a recliner seating section showing the interconnection of the mounting/stop bracket, front cross bar and second elongated guide rail.

DETAILED DESCRIPTION OF THE INVENTION

In accordance with the teachings of the present invention, an improved reclining mechanism for use in single person (i.e., chairs) and multi-person (i.e., sofas and loveseats) articles of furniture, together with a mounting apparatus particularly well-suited for removably securing a plurality of recliner sections together to form a modular sofa assembly. The mounting apparatus of the present invention will be discussed later herein.

The reclining mechanism of the present invention is a "three-way" mechanism which can be actuated to independently "recline" a seat back relative to a seat member or move a leg rest assembly between retracted and extended positions. When a person sits in a chair equipped with the improved reclining mechanism, the leg rest assembly is extended by selectively rotating an actuator lever. In addition, substantially concurrent "tilting" movement of the entire chair frame is provided upon such rotation of the actuator lever. Moreover, a full range of independent "reclining" movement of the seat back relative to the seat member is possible regardless of the operative position of the leg rest assembly between its fully "retracted" and "extended" positions. This reclining movement also produces substantially concurrent "tilting" movement of the chair frame. Therefore, tilting due to reclining movement of the seat back and tilting due to movement of the leg rest assembly are automatic, independent and cumulative in nature. Finally, the reclining mechanism of the present invention is relatively compact in size to permit use of loose upholstered cushions which is essential for marketing all styles of chair, sofa or loveseat furniture.

Figure 1A:
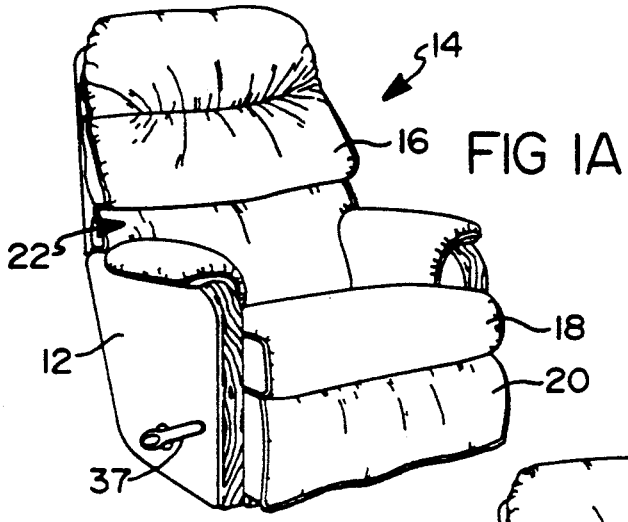
FIGS. 1A through 1D are perspective views of an exemplary upholstered reclining chair having an extensible leg rest assembly shown in various operative positions.
Figure 1B:
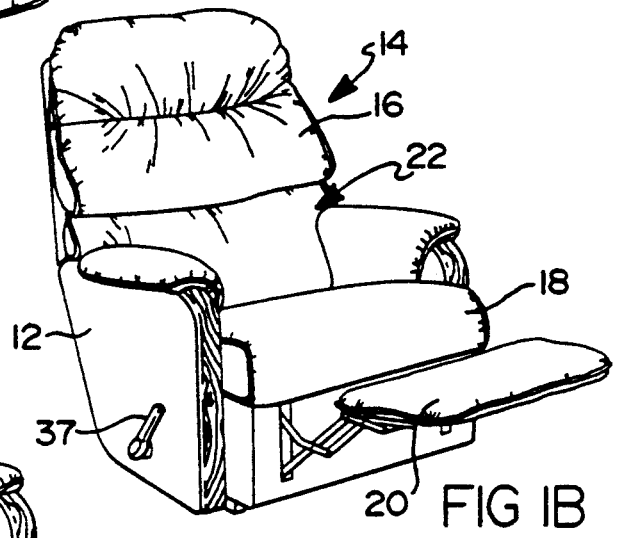
Figure 1C:
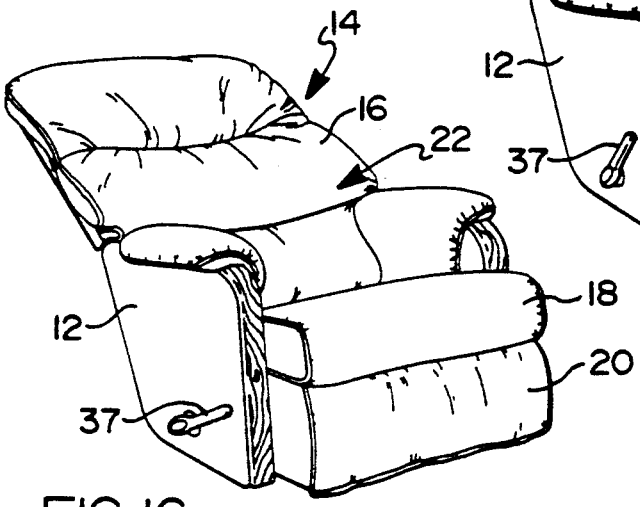
Figure 1D:
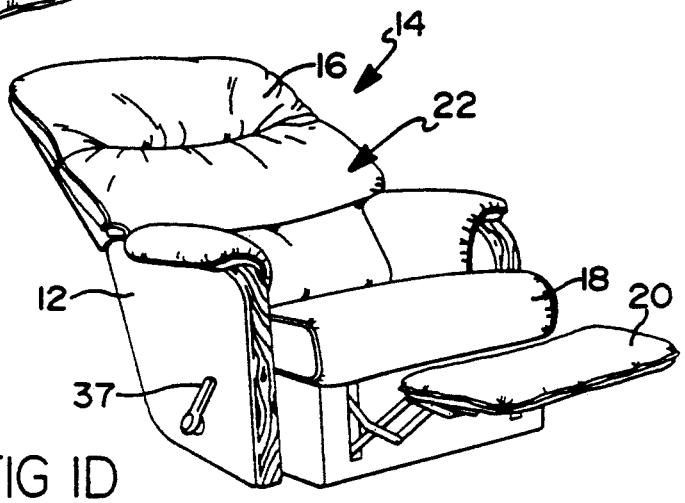

With particular reference now to the drawings, the operative relationship of an improved reclining mechanism 10 of the type adapted to support a prefabricated chair frame 12 will now be described. More particularly, FIG. 1A depicts an exemplary reclining chair 14 having its seat back 16 and seat member 18 shown in a fully "upright" position for permitting an occupant to enjoy conventional seating. FIG. 1B illustrates reclining chair 14 in the upright position with its associated leg rest assembly 20 being protracted to an elevated position. FIG. 1C illustrates chair 14 having seat back 16 moved to a "reclined" position relative to seat member 18 while leg rest assembly 20 is stowed in its retracted position. As will be described, seat back 16 and seat member 18 define a seat assembly 22 which is supported for reclining movement on chair frame 12. Reclining movement of seat assembly 22 is accomplished by the seat occupant deliberately applying pressure to seat back 16 such that a swing linkage mechanism causes seat member 18 to move forwardly and upwardly to maintain seating comfort while the included angle increases therebetween. All this is reversed, and chair 14 returned to its upright position upon deliberate application of rearward pressure to seat assembly 22 or, more simply, if the seat occupant leans forward to remove pressure from seat back 16. Finally, FIG. 1D depicts chair 14 in a reclined position with its respective leg rest assembly 20 extended. As will be described hereinafter in greater detail, movement of leg rest assembly 20 and/or reclining movement of seat assembly 22 cause corresponding tilting movement of chair frame 12 relative to the floor.

Figure 2:
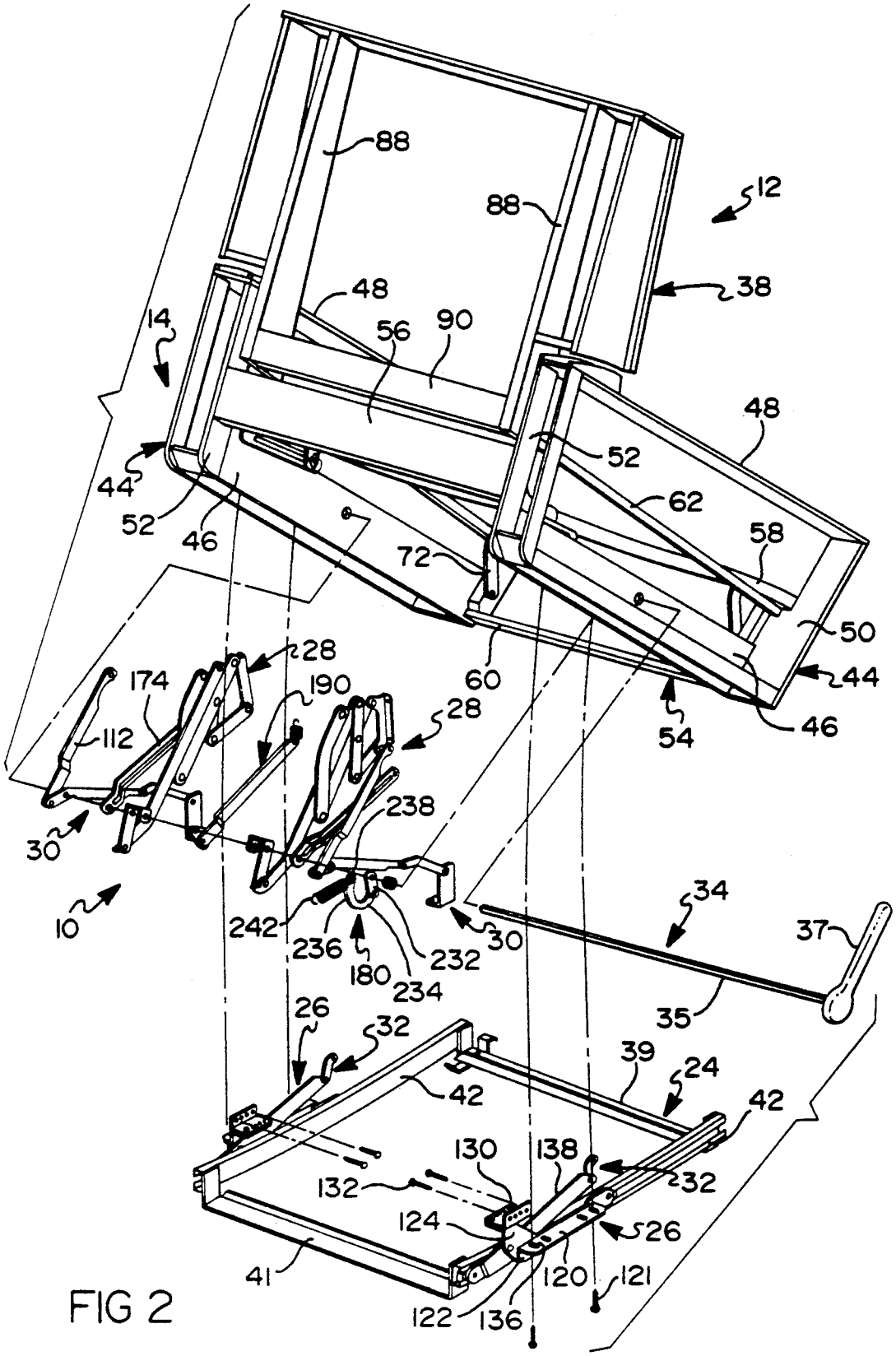
FIG. 2 is an exploded perspective view of the recliner chair of FIG. 1 with upholstery, springs, and other various parts removed, and which is partially disassembled for clarity, showing means for simply interconnecting the reclining mechanism to the chair frame.

With reference now to FIG. 2, an exploded perspective view of chair 14 is shown, with upholstery, padding, springs, etc. removed. In general, reclining mechanism 10 is shown to include a unitized base assembly 24, left and right bearing link assemblies 26 operatively interconnecting chair frame 12 to base assembly 24 for translational (i.e. fore and aft) movement, left and right pantograph leg rest linkage mechanisms 28, left and right push link mechanisms 30, tilt linkage means 32, and a drive assembly 34 for selectively actuating leg rest linkages 28 and tilt linkage means 32. More specifically, drive assembly 34 is shown to include an elongated square drive rod 35 supported within chair frame 12 and having a handle portion 37 provided adjacent an exterior side arm portion of chair 14 that can be easily reached by a person seated therein for convenient actuation thereof. However, it will be appreciated that other suitable manually operable release means known in the art, such as a push-button cable release or an concealed interior mounted actuator lever, can be readily incorporated into improved reclining mechanism 10 of the present invention.

Figure 5:
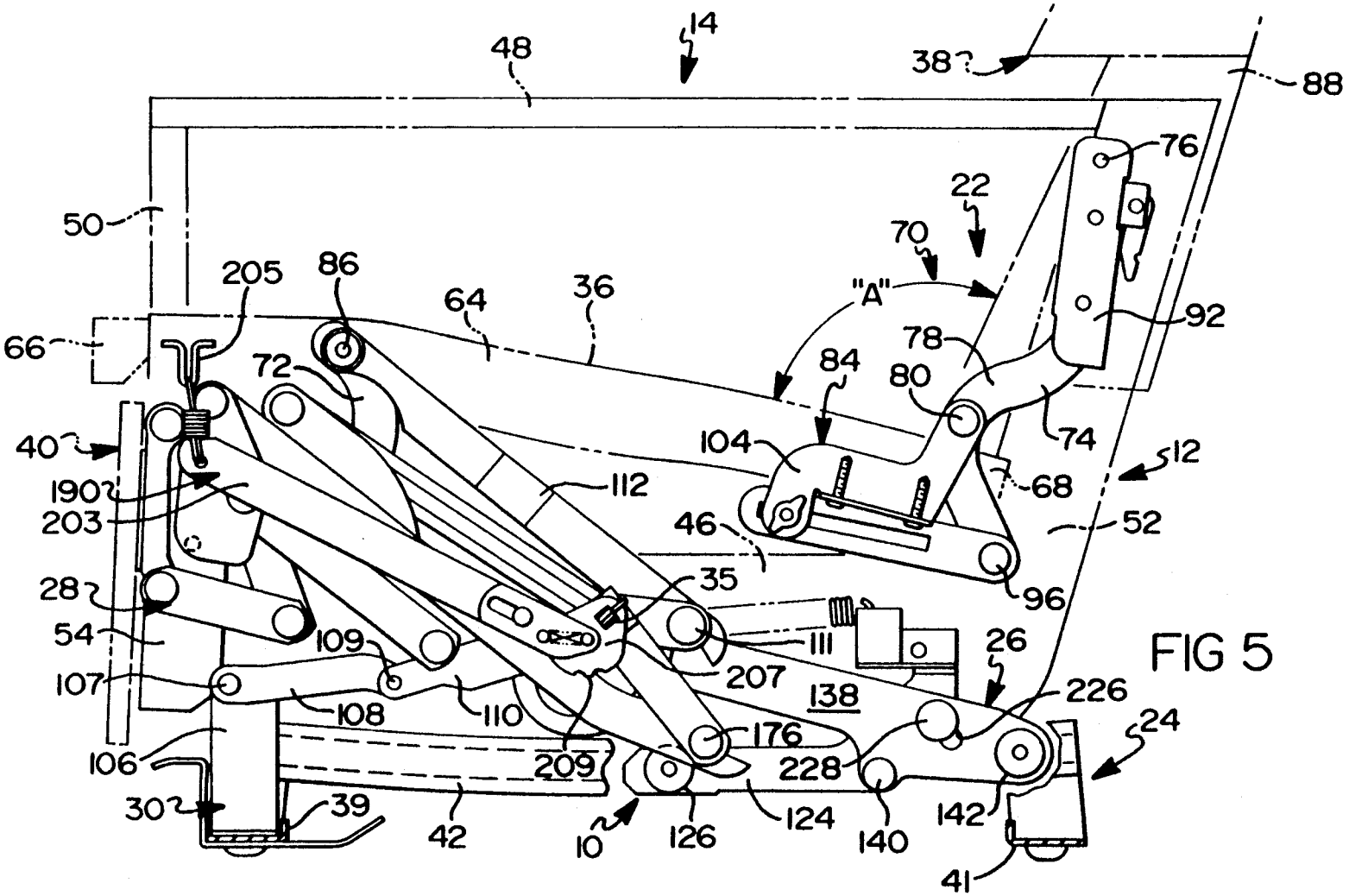
FIG. 5 is a partial schematic side view illustrating the reclining chair in an "upright" position.

With continued reference to FIG. 2, chair frame 12 is shown to be configured for retaining reclining mechanisms 10 substantially therein. As best seen in FIG. 5, various components of chair 14, such as chair frame 12, seat frame 36, seat back frame 38 and leg rest frame 40 are each constructed in a manner which enables them to support springs, padding, upholstery, etc., in order to complete a decorative and stylish chair 14 for use in the home. Preferably, these components are made of numerous wood rails that are fixedly secured together by suitable fasteners, such as dowels, staples, nails and screws, and which may be reinforced at critical joints by metal reinforcement plates or brackets and/or wood corner blocks in a known manner.

Unitized base assembly 24 forms a rigid rectangular frame defined by front and rear cross bars 39 and 41, respectively, secured to opposite ends of left and right metal channel-shaped tracks 42. Tracks 42 are outwardly facing and slightly curved relative to the floor and provide means for movably supporting left and right bearing link assemblies 26 so that they can move back and forth between front and rear cross bars 39 and 41. Base assembly 24 is adapted to be placed directly on the floor so as to eliminate the use of a heavy wooden base support typically used in most conventional reclining chairs. In addition, bearing link assemblies 26 are adapted to carry chair frame 12 so as to transfer substantially all loading from chair frame 12 and seat assembly 22 into base assembly 24.

As best seen in FIG. 2, chair frame 12 includes opposite side (i.e. left and right) frame members 44 in the form of rigid, roughly rectangular frames defined by relatively horizontal bottom members 46 and by relatively horizontal top members 48 which also function as chair arms. Each side frame 44 also includes a front post 50 which preferably has at least a lower portion substantially perpendicular to the floor. In addition, each side frame 44 has an inclined rear post member 52 such that front and rear posts 50 and 52, respectively, are rigidly secured to top and bottom horizontal members 44 and 46 respectively. The left and right hand side frames 44 are rigidly interconnected to form chair frame 12 by a front cross brace structure 54 and the rear cross brace member 56. The structure of front cross brace 54 comprises horizontal upper and lower cross pieces 58 and 60, respectively. A central wood post 62 is also shown for rigidly uniting front and rear posts 50 and 52. However, it is to be understood that chair frame 12 is merely exemplary in nature and that any suitable chair frame structure can be used with reclining mechanism 10.

Seat frame 36 is supported on chair frame 12 and is located between side frames 44 at a suitable distance between chair arms 48. Seat frame 36 is a rigid rectangular structure having left and right hand side bars 64 which are rigidly secured to opposite ends of front and rear cross pieces 66 and 68, respectively. Seat frame 36 is supported for movement on chair frame 12 by means of a swing linkage mechanism 70 for causing seat frame 36 to move substantially horizontally and slightly up or down, depending on whether seat frame 36 moves to the front (during reline) or to the rear (on return to upright). Swing linkage mechanism 70 includes left and right hand front swing links 72. More particularly, front swing links 72 are J-shaped members having their top ends pivotably connected to seat side bars 64 such that loading on seat frame 36 passes into front swing links 72. The lower end of J-shaped front swing links 72 are pivotably connected to a portion of front cross brace structure 54. Linkage mechanism 70 also includes left and right hand rear swing links 74 which extend vertically well above the level of seat frame 36 along side rear posts 52 of chair frame side frames 44 to which they are pivotably connected just below chair arms 48 about pivot point 76. A forwardly offset intermediate section 78 of rear swing links 74 is pivoted about pivot point 80 to an upstanding post section 82 of an angle seat bracket 84 having a horizontal flange securely fixed (such as by wood screws 85) to the underside surface of seat side bars 64 in relatively close proximity to the back end of seat frame 36. As such, loading on the rear of seat frame 36 passes from seat brackets 84 and pivots 80 into rear swing links 74 as tension in links 74 which is transferred by way of pivot 76 into chair frame 12. Thus, the rear of seat frame 36 moves much like a controlled pendulum on and below upper pivots 76 while the front of seat frame 36 swings to and fro above and on front pivot 86.

The primary means of moving rear swing links 74 is the application of pressure against seat back frame 38 above the level of pivot point 76, as when the seat occupant leans backward in chair 14. This action causes seat back frame 38 to pivot backwardly for causing rear swing links 74 to swing forwardly for initiating rolling forward movement of bearing link assemblies 26, and in turn, chair frame 12 in a manner to be described in greater detail hereinafter.

As is known, seat back frame 38 is also in the form of a rigid relatively rectangular assembly that includes right and left hand side members 88 and appropriate cross pieces, such as lower cross piece 90. Seat back frame 38 is removably mounted on the upper part of rear swing link 74 by means of slide brackets 92 secured at suitable locations on side members 88. A preferred form of slide brackets 92 for this type of mounting is shown and described in U.S. patent application Ser. No. 07/621,239 filed Nov. 30, 1990 and assigned to the common assignee of the present invention. More particularly, slide brackets 92 are channel-shaped to provide an interior track that slidably receives rear swing links 74 therein. When slide brackets 92 are mounted on rear swing links 74, seat back frame 38 is, in effect, an extension of rear swing links 74 above pivot points 76. As such, seat back frame 38 can be pivoted about pivots 76 for acting as a lever arm for causing relatively easy angularly movement of rear swing links 74. The force required for causing such movement, and thus fore and aft movement of chair frame 12, is preferably selectively adjustable via frictional resistance means shown in the form of a multiple layer left and right friction link members 94.

Friction links 94 have one end pivoted at 96 to a lower portion 98 of each rear swing links 74 and have an elongated slot 100 which receive a hand-adjustable spring-biased wing nut 102 and washer means (not shown) mounted on a downwardly extending forward arm 104 of seat brackets 84. As will be appreciated, the frictional resistance of links 94 to sliding movement of wing nut 102 in slot 100 and thus to pivotal movement of rear swing link 74 can be selectively adjusted by tightening wing nut 102 to suit the specific user of the chair. While not shown, spring means may be attached between forward extension 104 of seat brackets 84 and rear cross member 56 of chair frame 12 for normally biasing seat assembly 22 so as to assist in maintaining the "upright" included angle "A" between seat member 18 and seat back 16.

Left and right push link mechanisms 30 are provided for causing translational "fore and aft" movement of bearing linkage assemblies 26 and, in turn, chair frame 12 relative to base assembly 24 in response to the pressure applied by the seat occupant to seat back 16. In general, push linkage mechanisms 30 are interconnected between front cross bar 39 of base assembly 24 and pivots 86 at the forward portion of seat frame 36. More particularly, base brackets 106 extend vertically from front cross member 39 of base assembly 24. A first end of lower push links 108 are pivotally connected at pivot 107 to an upper end of base brackets 106. The opposite end of lower push links 108 are pivotally connected at pivots 109 to a first end of drive rod swing links 110 which are journally supported on drive rod 35. The opposite end of drive rod swing links 110 are pivotally connected at pivot 111 to the lower end of offset upper pull links 112, the upper ends of which are pivotally connected at pivot points 86 to the respective side bars 64 of seat frame 36. Preferably, drive rod swing links 110 have a central aperture through which a spacer sleeve 114 (FIG. 3) is disposed and which is concentrically supported on square drive rod 35. Thus, square drive rod 35 fixes the longitudinal position of drive rod swing links 110 and upper pull links 112 but is independently operable with respect to angular movement thereof. As such, when pressure is applied by the seat occupant to move between the FIG. 5 "upright" position and the FIG. 6 "reclined" position, push link mechanisms 30 cause corresponding fore and aft translational movement of chair frame 12 via movement of bearing linkage assemblies 26 within tracks 42. In addition, the slightly "down-hill" curvature of tracks 42 cause chair frame 12 to tilt relative to the floor upon translational movement thereof.

For purposes of clarity, the term "tilting" refers to angular movement of chair frame 12 and, in turn, seat assembly 22 about a horizontal axis relative to stationary base assembly 24. Such "tilting" movement occurs substantially concurrently with protraction of leg rest linkages 28 via selective rotation of actuator lever 37 by the seat occupant and/or upon reclining movement of seat assembly 22. The term "reclining" refers generally to the angular movement of seat assembly 22 relative to chair frame 12 and, more particularly, to the relative angular movement of seat back 16 with respect to seat member 18 via swing linkage mechanism 70 for increasing the included angle therebetween from a minimum "A" (i.e. upright) to a maximum "B" (i.e. reclined). Moreover, the present invention is designed to permit the seat occupant to select and maintain virtually any desired reclined position within the range of reclining movement between the included angles "A" and "B".

With particular reference now to FIGS. 3 through 9, the primary components of reclining mechanism 10 which produce the above-noted movement characteristics will now be described in more detail. As noted, reclining mechanism 10 includes left and right wheel bearing link assemblies 26 provided for movably supporting chair frame 12 for longitudinal "fore and aft" movement relative to tracks 42 of stationary base assembly 24. Moreover, the fore and aft movement of chair frame 12 causes substantially simultaneous corresponding reclining movement of seat assembly 22 and tilting movement of chair frame 12. In addition, wheel bearing link assemblies 26 are operatively coupled to tilt linkage means 32 for causing independent tilting movement of chair frame 12 upon corresponding actuation of leg rest assembly 20 via rotation of drive rod 35. As will be appreciated, upon raising leg rest assembly 20 to an intermediate position, tilt linkage means 32 only produces a proportional amount of tilting movement.

In general, left and right bearing link assemblies 26 are mirror-imaged wheeled assemblies disposed respectively for rolling movement in left and right tracks 42 of base assembly 24. Preferably, tracks 42 are aligned in parallel relationship and are slightly downwardly curved from back to front to generate a gravity-assisted "down-hill" rolling movement of the wheeled unit therein. More specifically, bearing link assemblies 26 each include an angled bracket 120 adapted to be securely affixed directly to the bottom edge surface of horizontal bottom members 46 of chair frame 12 such as by wood screws 121. Angled brackets 120 include a downwardly extending flange 122 connected to a bearing link member 124 having a forward wheeled rolling unit 126 supported thereon and which is rollingly disposed within tracks 42. The upper rear end of bearing link 124 has a right-angled flange 127 having at least one elongated slot 128 provided for permitting a secondary mounting/stop bracket 130 to be adjustably mounted thereto. Secondary mounting/stop bracket 130 is provided for securely attaching bearing link 124 to an inner vertical surface of horizontal bottom members 46, such as by wood screws 132. Accordingly, elongated slot 128 on bearing link flange 126 and slots 136 in angled bracket 120 permit selective side-to-side adjustment of bearing link assemblies 26 to compensate for manufacturing tolerances in base assembly 24 and/or chair frame 12. A pivot lever 138 is pivotally connected to bearing link 124 and angle bracket 120 about pivot point 140. More particularly, pivot lever 138 includes a second rear wheeled unit 142 rolling disposed in tracks 42 with the opposite end of pivot levers 138 secured to respective left and right "tilt" linkage means 32, the structure and operation of which will be described hereinafter.

Figure 6:
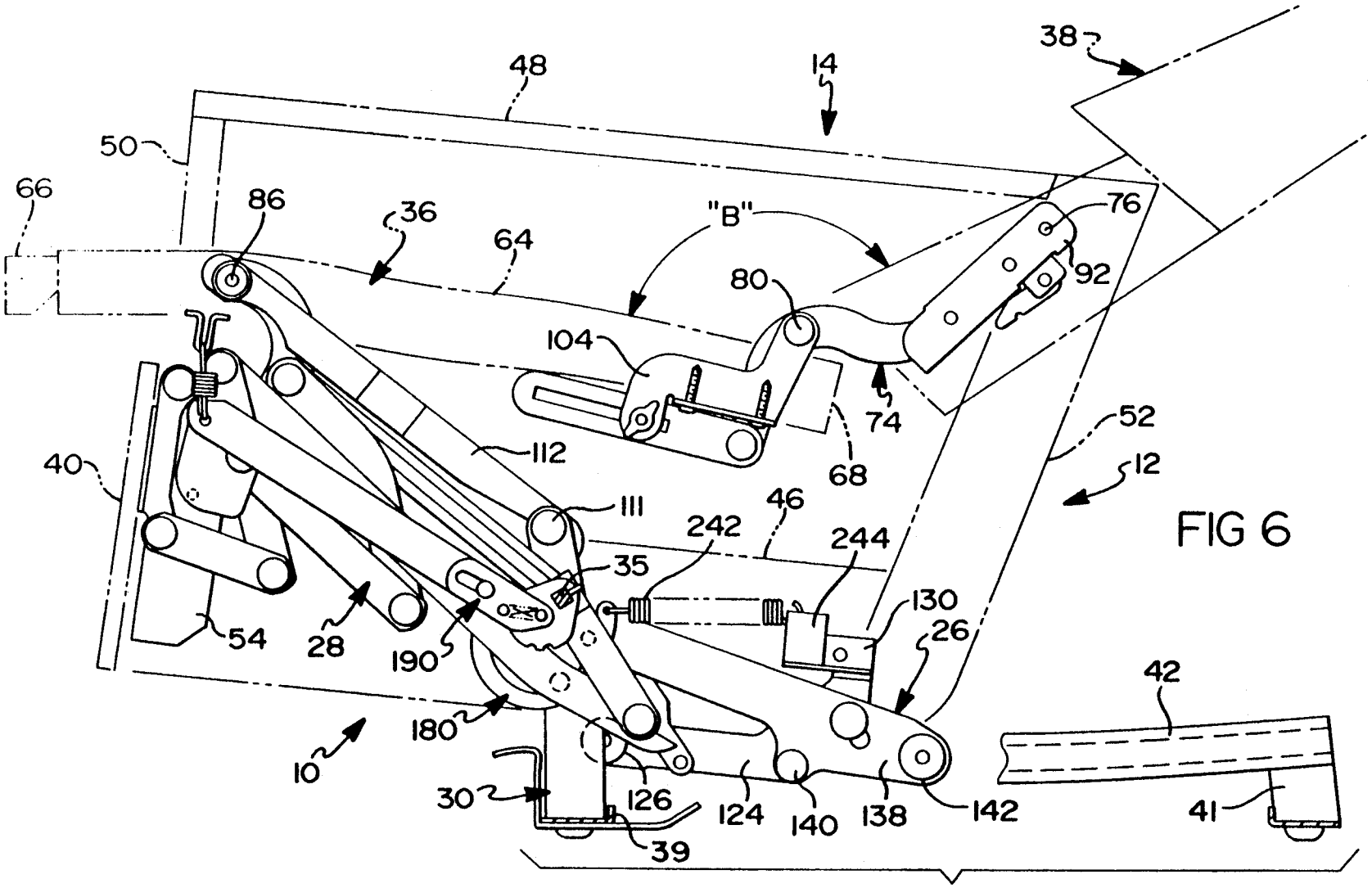
FIG. 6 is a side view, similar to FIG. 5, illustrating the reclining chair in a fully "reclined" and "tilted" position.
Figure 7:
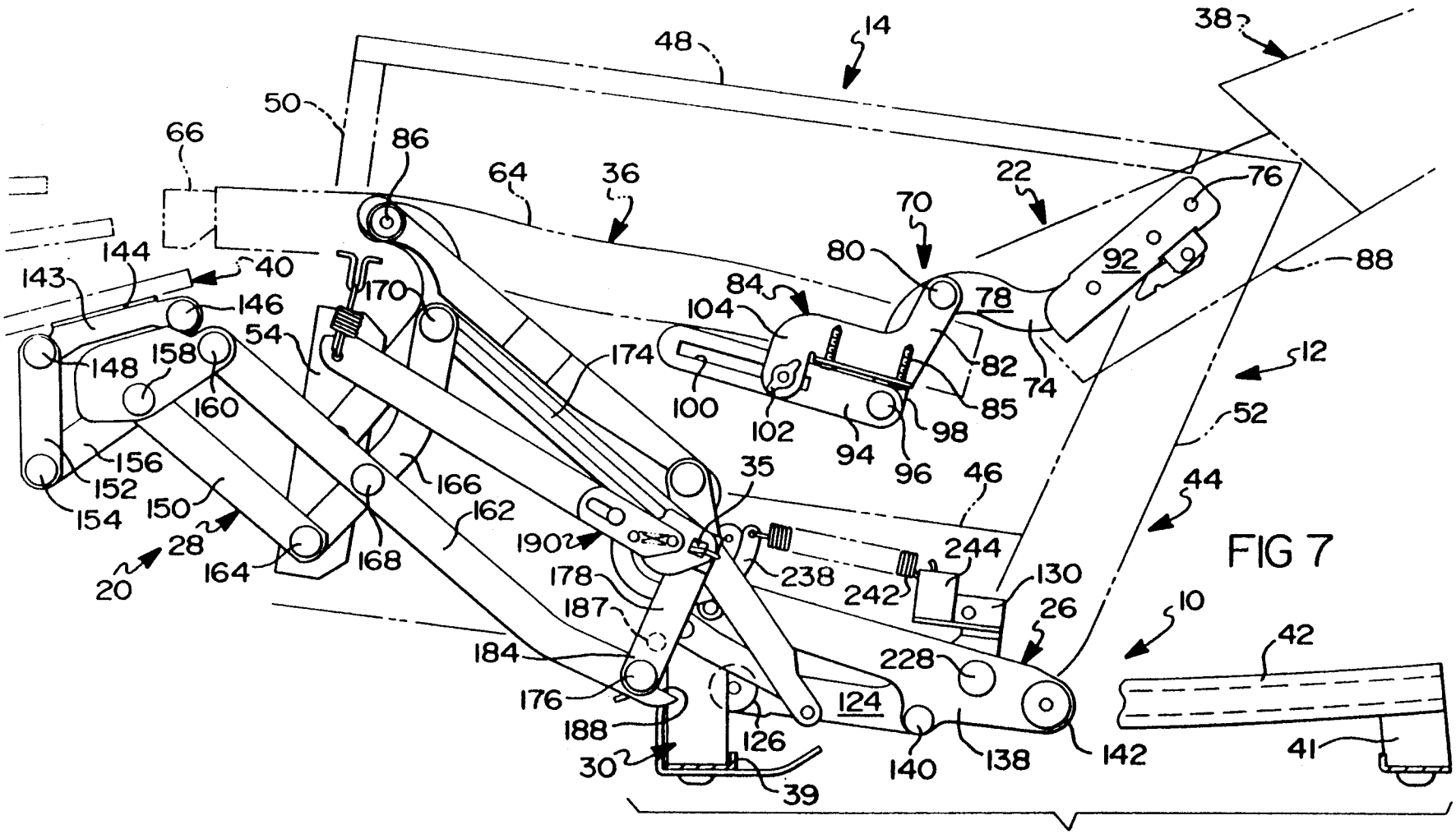
FIG. 7 is a side view, similar to FIG. 6, with the leg rest assembly in an extended position wherein the chair frame is further "tilted" to the base assembly.
Figure 8:
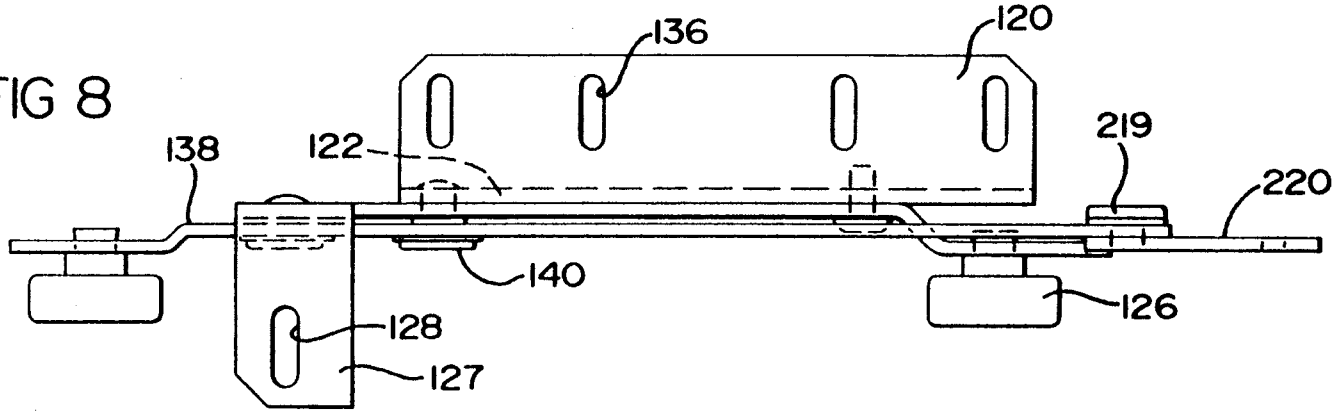
FIG. 8 is an enlarged plan view of the left-hand bearing link assembly shown in FIG. 3.
Figure 9:
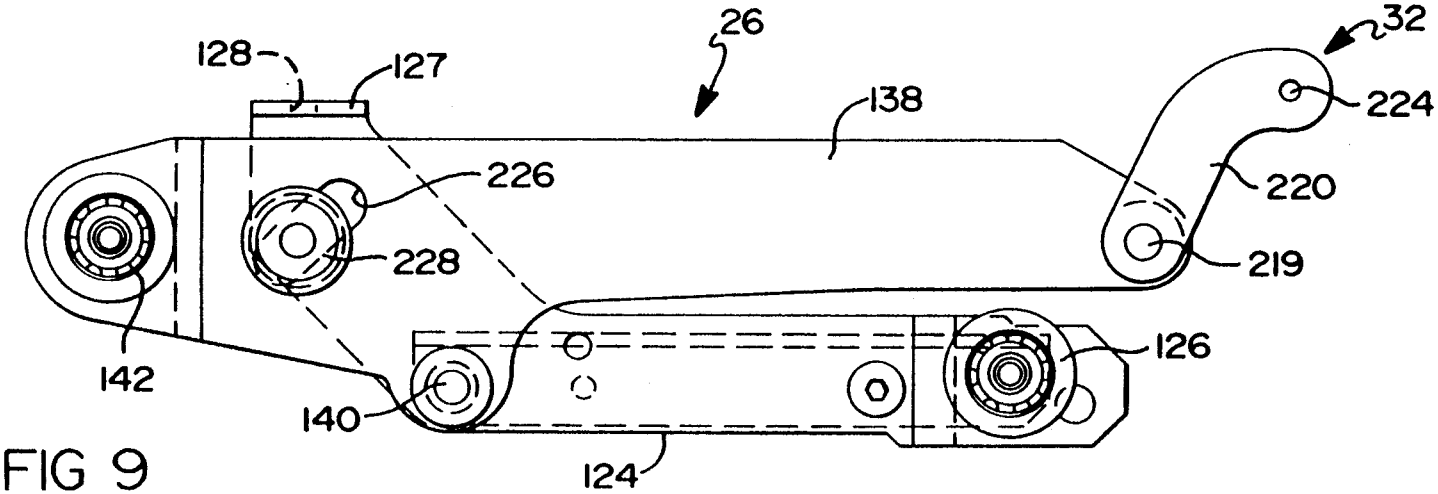
FIG. 9 is a side view of FIG. 8.

With particular reference now to FIGS. 5 through 7, leg rest assembly 20 is shown to include frame board 40 having an outer surface that is padded and upholstered so that finished chair 14 will be seen as in FIG. 1. Frame board 40 is supported and moved by identical left and right hand pantograph linkages 28. Pantograph linkages 28 are substantially identical in function and structure to that shown in FIG. 9 of U.S. Pat. No. 4,367,895. However, for a better understanding of their operation, a brief description is included herein. More particularly, frame board 40 has an angled bracket 143 secured to its bottom face 144 for each pantograph linkage 28 whereby board 40 is pivotably connected at a rear pivot 146 and a front pivot 148 to one end of board links 150 and 152, respectively, of pantographs 28. The opposite end of front board link 152 is pivoted at 154 to an end of a connector link 156 which, in turn, is centrally pivoted at 158 to a portion of rear board link 150. The other end of connector link 156 is pivoted at 160 to a top end of a long support link 162. The other end of rear board link 150 is pivoted at 164 to one end of a curved link 166 which is pivoted at a central pivot 168 to a central portion of long support link 176. The other end of curved link 166 is pivotably connected at pivot 170 to a front support bracket 172 (FIGS. 3 and 4) mounted to chair frame front cross member 58. Ribbed offset lateral support members 174 extend from square drive rod 35 to pivot 170 to provide lateral support and maintain the desired spacing between left and right pantograph mechanisms 28.

Another point of support is pivot 176 at the curved bottom end of long support link 162 which connects support link 162 to a first end of a drive link 178, the other end of which has a square aligned hole through which square drive rod 35 extends such that drive link 178 is driven by angular movement of drive rod 35. Thus, rotation of drive rod 35 turns drive link 178 which acts through pivot 176 to move long support link 162. Such movement of support link 162 causes curved link 166 to swing about fixed pivot 170 by virtue of pivot connection 168 that curved link 166 has with long support link 162. The action of link 166 swinging about fixed pivot 170 acts to move rear board link 150 outwardly and upwardly. In addition, pivot 169 at the top end of long support link 162 causes connector link 156 to swing about pivot 158 such that front board link 152 is also moved outwardly and upwardly. This extensible action takes place simultaneously with both the left hand and right hand pantograph linkage mechanism 28 when there is sufficient angular rotation of drive rod 35 via handle 37. As such, the effect is to move frame board 40 between its stowed vertical position (FIG. 5) and one of its elevated protracted position (FIG. 7).

Figure 3:
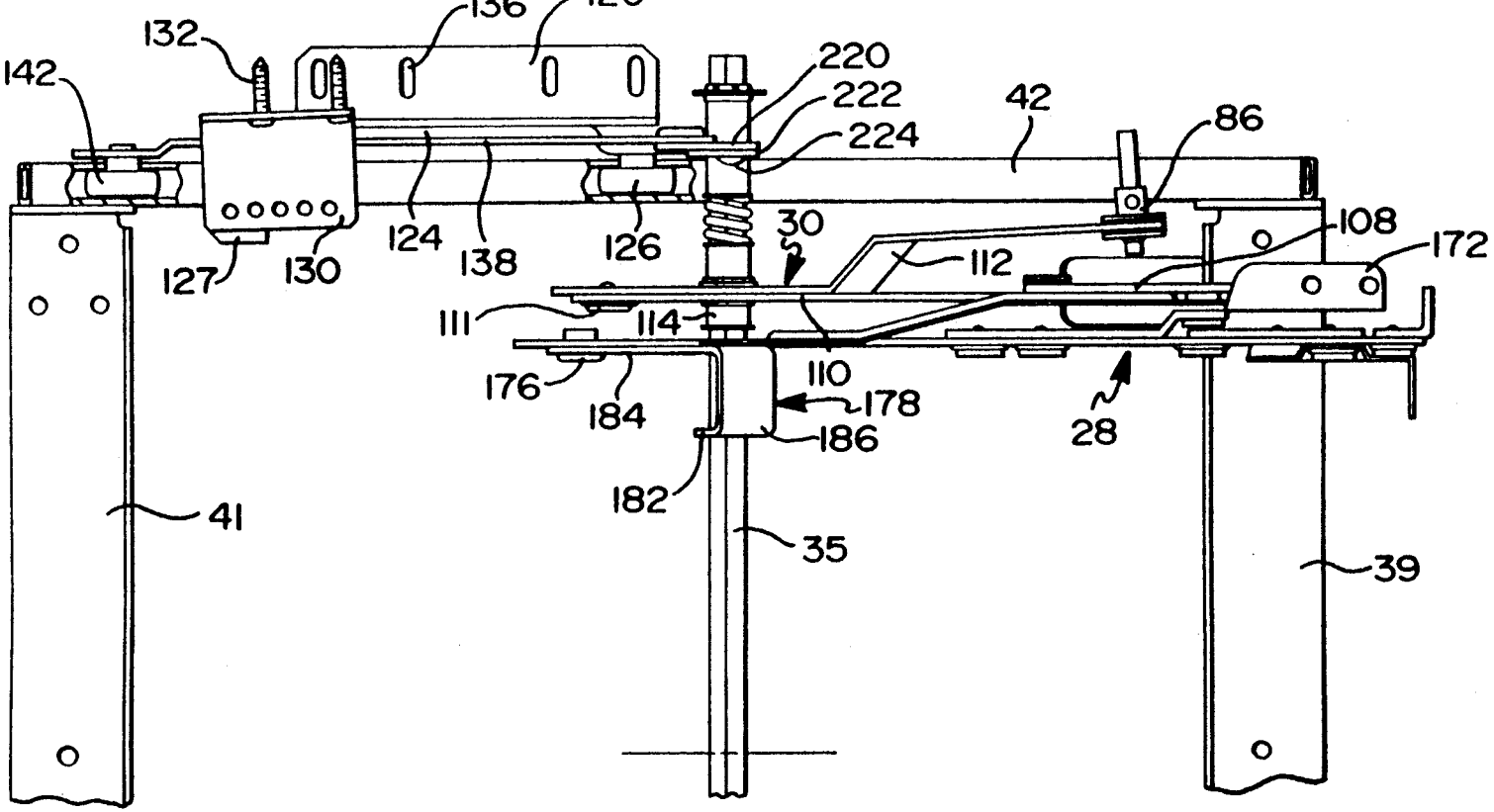
FIG. 3 is a plan view of a left-half portion of the recliner mechanism of FIG. 2.
Figure 4:
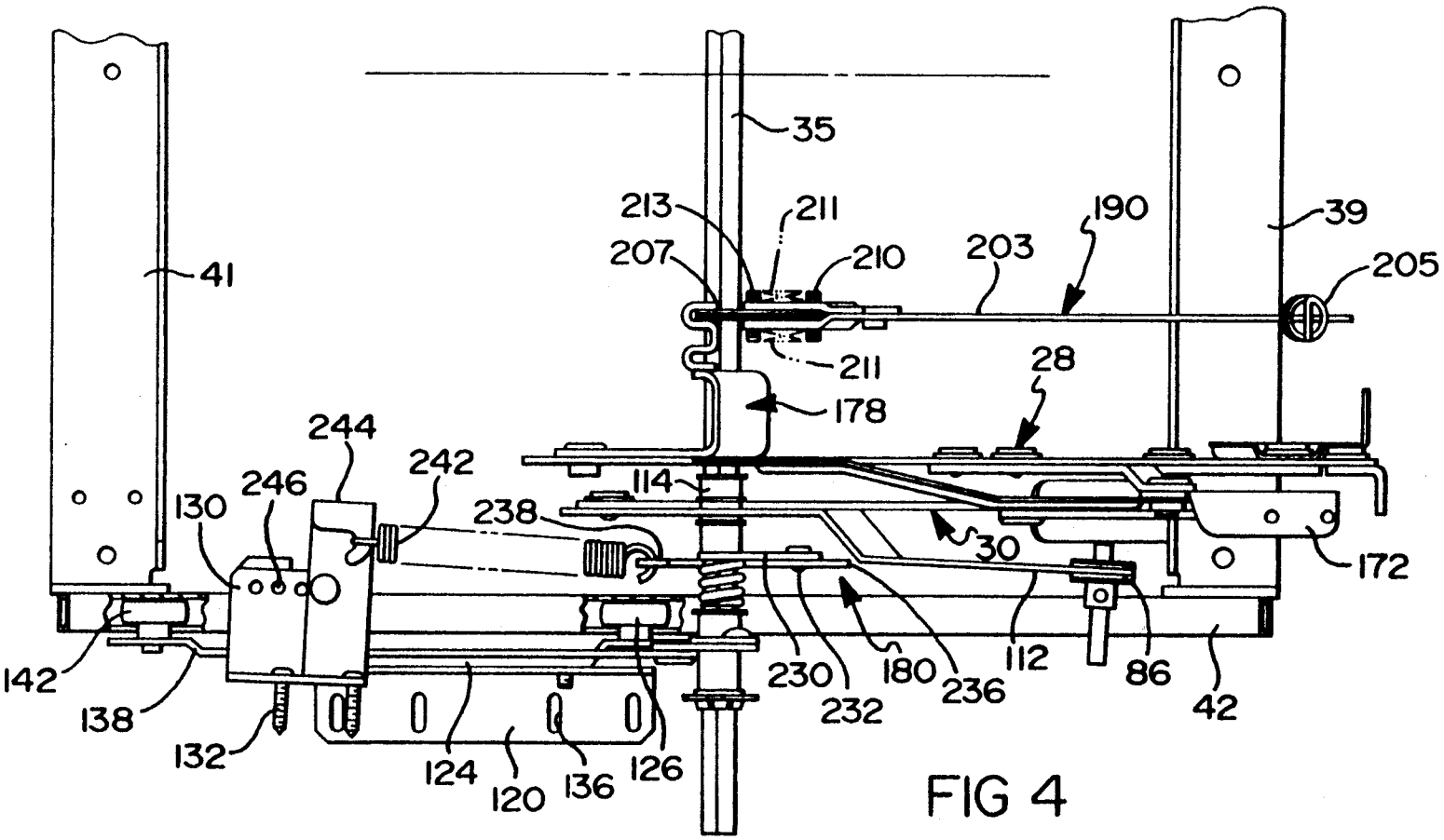
FIG. 4 is a plan view of a right-half portion of the recliner mechanism of FIG. 2.

As best seen in FIGS. 3 and 4, drive link 178 is generally U-shaped having parallel short and long legs 182 and 184, respectively, joined by a base 186. Both legs have square aligned holes in them through which the square drive rod 35 extends. In the fully extended horizontal position of leg rest assembly 20, a cold deformed stop tab 186 on long leg 184 contacts a stop shoulder 188 formed on the lower end of long support link 162 when long leg 184 and link 162 are almost in relatively collinear alignment. Due to engagement of stop tab 186 and stop shoulder 188, pantograph linkages 28 cannot go over-center such that leg rest frame 40 is held in the protracted position. A ratchet type detent mechanism 190 interconnects drive rod 35 and front structure 56 of chair frame 12 for providing various intermediate lockable protracted positions for leg rest 20 (shown in phantom in FIG. 7).

The structure of ratchet mechanism 190 includes an inclined link 203 which is suspended at its front end from upper cross piece 58 of chair frame 12 by a tension spring hanger assembly 205. The other end of link 203 is bifurcated to receive a sector-shaped plate member 207 that is mounted by way of a square hole on drive rod 35 so as to rotate therewith. Rachet plate 207 has specially shaped recesses 209 in its outer periphery which act as ratchet means cooperating with a floating detent pin 210 carrier by the bifurcations and urged into recesses 209 by tension springs 211 anchored on a pivot pin 213 between plate 207 and link 203. When drive rod 35 is rotated to operate leg rest assembly 20, plate 207 is also rotated to expose different recesses 209 to pin 210 depending upon the degree of rod rotation and the elevation. When pin 210 is lockingly biased into one of recesses 209, leg rest assembly 20 is yieldably held in an elevated position against inadvertent angular movement by mechanism 190. Spring assembly 205 accommodates relative movement between link 203 and cross piece 58 due to movement of pin 213 upon rotational plate 207. Leg rest assembly 20 can only be returned to its stowed position from an intermediate position by fully protracting leg rest 20. Thereafter, reverse rotation of handle 37 cause pantograph linkages 28 to return to the FIG. 5 stowed condition.

As noted, reclining mechanism 10 is confined below seat frame 32 with tracks 42 being an integral portion of base assembly 24. In this manner, the wooden bottom support rails typically incorporated into conventional reclining systems have been eliminated. Therefore, an overall reduction in the height of recliner 10 permits use of loose cushions removably installed on top of seat frame 36. In addition, reclining mechanism 10 is designed to cause less upward angular movement of seat frame 36 than conventional recliners upon forward "reclining" motion thereof as well as during "tilting" movement for significantly reducing the effort required for the seat occupant to return seat assembly 22 to the upright position.

According to the present invention, selective angular movement of drive rod 35 about its axis causes actuation of leg rest assembly 20 and "tilting" movement of chair frame 12. In addition, the weight of the seat occupant and the center of gravity of seat assembly 22, defined by the orientation of front and rear wheeled units 126 and 142 disposed within tracks 42, combine to generate a forwardly directed force on bearing link assemblies 26 which tends to augment the limited occupant input (i.e. pressure to seat back 16) required for causing substantially smoother operation of recliner 10. In addition, an over-center spring-loaded toggle assembly 180 is designed to selectively assist in driving leg rest assembly 20 between its respective "stowed" and "extended" positions.

With particular reference now to FIGS. 2, 3, 4, 8 and 9, bearing bracket assemblies 26 are shown to be operatively coupled to tilt linkage means 32 for "tilting" chair frame 12 relative to the floor upon movement of leg rest assembly 20. In general, tilt linkage means 32 interconnect the forward end of pivot levers 138 of bearing link assemblies 26 to drive assembly 32. More particularly, the forwardmost end of pivot levers 138 extend below and are generally aligned with the axis of drive rod 35 and are pivotally connected at pivot 219 to a lower end of a J-shaped toggle link 220. The other end of J-shaped toggle link 220 is pivotably connected to a connector link 222 at pivot 224 and which, in turn, is secured on drive rod 35 for angular movement therewith. Tilt linkage mechanisms 32 inhibit tilting movement of chair frame 12 until actuator lever 37 and, in turn, drive rod 35 are rotated for causing pivotal movement of pivot levers 138 relative to bearing links 124. More particularly, pivot levers 138 are formed with a lost motion slot 226 through which a rivet 228, extending through bearing link 124, moves to define a limited range of angular movement between pivot levers 138 and bearing links 124 Therefore, upon rotation of drive rod 35, the corresponding rotation of connector link 222 cause toggle link 220 to drive the forward end of pivot levers 138 downwardly. At this point, the mechanical advantage of tilt linkages 32 act to forwardly drive J-shaped toggle 22 around and below drive rod 35 so as to permit pivot levers 138 to pivot about pivot points 140 such that bearing link assemblies 26 and, in turn, chair frame 12 are "tilted" relative to tracks 42. In addition, rivet 228 provides structural support to chair 14 for maintaining the alignment and rigidity of pivot lever 138 for causing wheeled unit 142 to run straight within track 42. As such, lateral (i.e. side-to-side) cross-members can be eliminated since the rigidity of chair frame 12 is used to maintain correct wheel alignment to track 42.

As best seen in FIGS. 4 and 7, at least one spring-assist toggle assemblies 180 is provided which, as pointed out in U.S. Pat. No. 4,367,895, works coactively with leg rest pantograph linkages 28. Toggle assembly 180 provides means for holding leg rest assembly 20 tightly in a fully retracted (i.e., stowed) position against front brace structure 54 of chair frame 12 while also providing means for supplying a spring force for driving leg rest assembly 20 toward one of its extended positions. Toggle assembly 180 includes a toggle lever 230 with a square hole which is mounted by means of the square hole on square drive rod 35 for selective rotation therewith. Toggle lever 230 is pivotally connected at pivot 232 to front leg 234 of a C-shaped toggle link 236 that curves around, below and to the rear of drive rod 35 where its rear leg 238 has an opening in which one end of a helical coil spring 242 is hooked. The opposite end of spring 242 is hooked to a spring bracket 244 which is secured to secondary mounting/-stop bracket 130. Tension adjustment means, such as a plurality of holes 246 in mounting/stop bracket 130, are provided for adjusting the tension in spring 242. For example, the tension in spring 242 can be adjustable relieved for a lighter weight occupant or it can be increased for a heavier seat occupant. Such adjustment means provide an extra comfort and convenience feature to reclining mechanism 10.

Operation of toggle assemblies 180 will now be described in greater detail. The location of pivot 232 below drive rod 35 and the line of action of spring 242 are such that in the retracted position of leg rest assembly 20, the spring force holds or "retains" leg rest assembly 20. As leg rest 20 is initially extended upon slight rotation of actuator lever 37 and, in turn, drive rod 35, pivot 232 moves up and over center of the drive rod axis. Once pivot 232 is over-center, tension loading on spring 242 assists in drivingly rotating drive rod 35 for elevating leg rest assembly 20 as rear leg 238 of link 236 is pulled toward secondary mounting/stop bracket 130. In addition, spring 242 assists the occupant in pivoting handle 37 through the require actuation angle. Furthermore, toggle assembly 180 is adapted to utilize the spring biasing force of spring 242 to assist in returning leg rest assembly 20 to its stowed position upon reverse rotation of handle 37.

According to the operative principles of the present invention, leg rest assembly 20 and the associated tilting movement of chair frame 12 on base assembly 24 both occur upon selective angular movement of handle lever 37. Operation of the recline feature of reclining mechanism 10 and its associated tilting movement of chair frame 12 however, occur simply by weight shifting on the part of the seat occupant with no spring or lever assistance. When the chair occupant lets the weight of his or her back rest heavily against seat back frame 38, most of the load will be concentrated above pivots 76 so that rear swing links 74 plus seat back frame 38 become long lever arms that transform the pressure applied into forward motion of bearing link assemblies 26 in tracks 42 via actuation of push link mechanisms 30. To reverse this motion and return chair 14 to its upright position, the seat occupant simply leans forward to take his or her weight off seat back frame 38 and let that weight component be carried by seat frame 36. The weight balance provided by swing linkage 70 and tilt linkage 32 in conjunction with the load balancing due to the positioning of wheeled units 126 and 142 in tracks 42, enable the translational movements just described to be started, continued and terminated without the need for the seat occupant to push against chair arms 48 or any other forms of additional leverage.

Referring now to FIGS. 10–13, a mounting apparatus 300 in accordance with the present invention is shown. Also shown are a plurality of independent, modular seating sections 302, 304 and 306, with seating sections 302 and 306 being of the recliner type and having recliner mechanisms like that disclosed hereinbefore. The mounting apparatus 300 of the present invention generally comprises a first elongated, L-shaped frame rail 308 and a second elongated, L-shaped frame rail 310. The frame rails each comprise a plurality of circular openings 312 and a plurality of elongated openings 314, shown in FIG. 11. The frame rails 308 and 310 preferably comprise elongated sections of L-shaped angle iron, although it should be appreciated that other materials could easily be employed provided such materials have relatively good structural strength and rigidity and are suited for the intended purpose described herein.

Figures 10, 14:
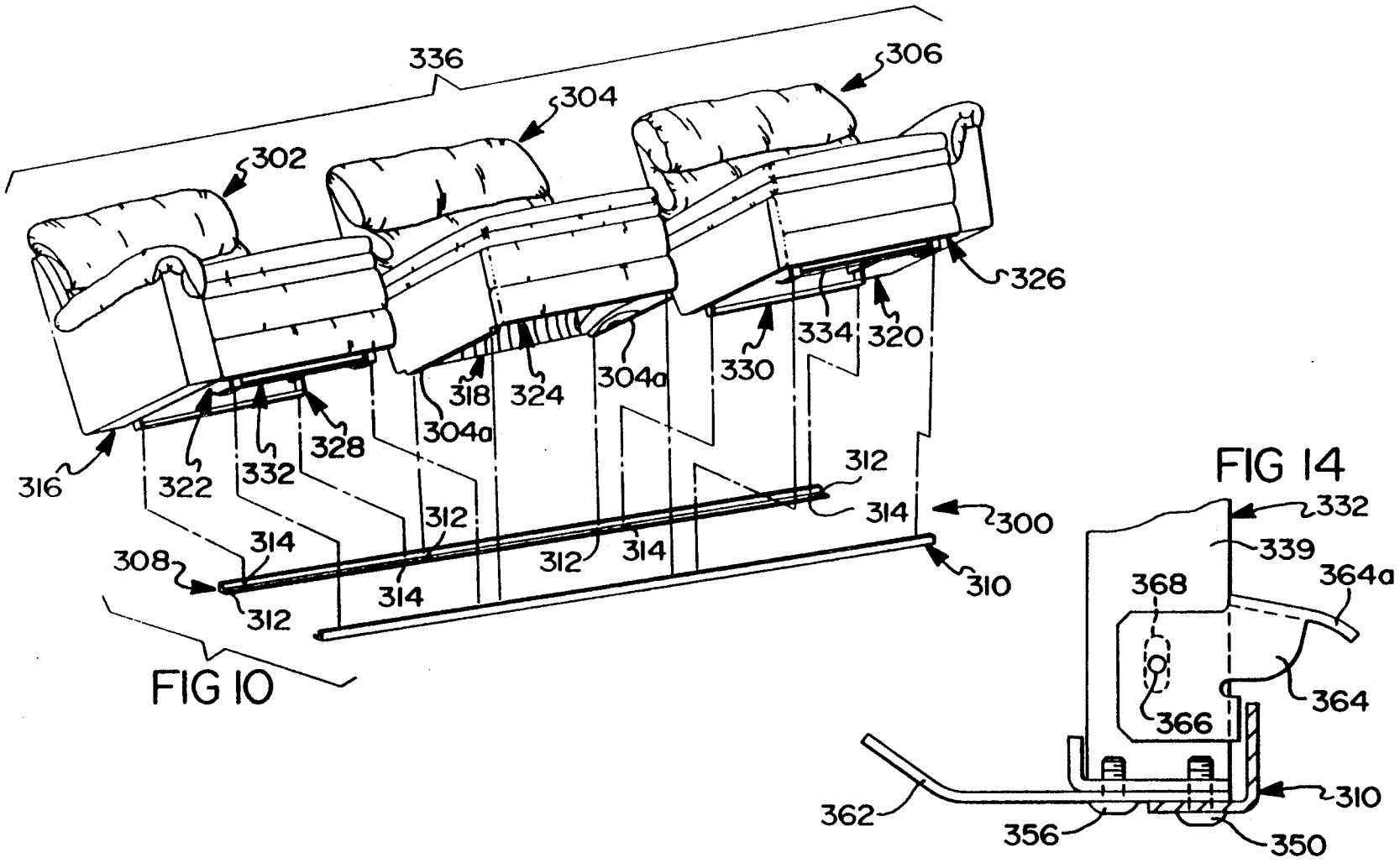
FIG. 10 is an exploded perspective view of a modular sofa assembly in accordance with the present invention showing how three independent seating sections may be alignably configured together in a side-by-side arrangement and removably secured together via a pair of parallel, spaced apart frame rails of the invention.
FIG. 14 is a partial cross-sectional view of an alternative preferred embodiment of a mounting and stop bracket.

With specific reference to FIG. 10, each seating section 302–306 includes a lower rear end portion 316–320 and a lower front end portion 322–326, respectively. Secured to the rear end portions 316 and 320 are rear cross bars 328 and 330 respectively. The lower front end portions 322 and 326 of recliner seating sections 302 and 306 similarly include front cross bars 332 and 334, respectively. Center seating section 304 includes side edge portions **304*a*, the function of which will be discussed below. Although the center seating section 304 is not shown as including a front or rear cross bar, it should be appreciated that these components could be readily mountably included if so desired. Showing center seating section 304 without these components is intended to illustrate that the front and rear cross bars 332, 334 and 328, 330 may not be necessarily required where a fixed seating section, (i.e., a seating section not of the recliner type) is used, which fixed seating section does not incorporate a reclining mechanism, and that a frame portion of the fixed seating section, such as side edge portions 304*a*, may simply be mounted to the frame rails 308 and 310 if desired, via apertures 312** and any suitable securing members such as threaded bolts or screws.

FIG. 10 illustrates how the independent seating sections 302–306 are adapted to alignably mount together in a side-by-side configuration to form a single, modular sofa assembly, designated by reference numeral 336. It should be appreciated, of course, that seating sections 302 and 306 which are disposed on the ends of sofa 336 need not be recliner sections but could instead be fixed seating sections if so desired. It is an important advantage of the present invention that varying types of independent seating sections can be secured to the mounting apparatus 300 to custom design a modular sofa assembly in accordance with the needs of the distributor or individual owner.

Referring to FIGS. 11–13, the manner in which the independent seating sections 302 and 306 are alignably coupled to the mounting apparatus 300 is shown. Although the center seating section 304 is not shown in FIG. 11, it should be appreciated that all of the seating sections 302–306 may be placed in longitudinal alignment within frame rails 308 and 310. In addition, two seating sections could be employed if desired to form a loveseat, or more than three seating sections could be used to form an extra-large, "oversized" modular sofa assembly.

Initially, the seating sections 302–306 are preferably tipped rearwardly to place the lower front and rear end portions 316–326 upwardly in a readily accessible manner, and alignably positioned to place the seating sections 302–306 closely adjacent each other in a side-by-side configuration. Accordingly, each of the frame rails 308–310 may be secured to the front and rear lower end portions 316–326 without unnecessary movement or manipulation of the individual seating sections 302–306. Thus, attachment of the frame rails 308–310 may be effected by a single individual without the need to hold or otherwise support various portions of the individual seating sections 302–306 while the frame rails 308–310 are being secured.

As shown in FIG. 11, each section 302 and 306 includes a plurality of generally L-shaped mounting/stop brackets 338, 340 and 342, 344, respectively, secured to their respective cross bars 332 and 334. Frame rail 308 is adjustably positioned so that elongated apertures 314 are approximately aligned over threaded openings in mounting/stop brackets 338 and 340. A representative one of such openings is shown in FIG. 12 and denoted by reference numeral 346. Threaded openings in the cross bar 332, denoted by reference numeral 348 in FIG. 13, are longitudinally aligned with threaded openings 346 to enable the mounting/stop bracket 338 to be interlocked inbetween frame rail 310 via threaded screw 350, a representative of one which is illustrated in FIG. 12, and cross bar 332 when the frame rail 310 is secured to the cross bar 332.

With reference to FIG. 12, the mounting/stop bracket 338 is preferably additionally secured to cross bar 332 via other threaded openings 352 and 354 and threaded screw 356. Mounting/stop bracket 338 is thus able to be secured to the cross-bar 332 at a manufacturing or assembly facility of the manufacturer and shipped as part of the seating section 302 if desired.

Although the assembly and interconnection of frame rail 310 has been discussed with respect to only mounting/stop bracket 338, it should be appreciated that the assembly of frame rail 310 to mounting/stop brackets 340, 342 and 344 is substantially identical, and as such has not been discussed.

With reference to FIGS. 11 and 13, frame rail 308 is similarly alignably positioned with elongated openings 314 approximately over threaded openings in cross bar 328. A representative one of these openings 358 is illustrated in FIG. 13. A threaded screw 360 removably secures the frame rail 308 to the cross bar 328. As with frame rail 310, frame rail 308 is secured in a substantially identical manner to cross bar 330, and as such will not be discussed.

The elongated shape of elongated apertures 314 serves to allow a degree of adjustability when securing the frame rails 308 and 310 to the chair sections 302–306 by allowing the frame rails 308 and 310 to be slidably positioned over the cross bars 328, 330 and 332, 334. This reduces the criticality of the exact placement of the openings 346, 348 and 354 by easing slightly the tolerances with which the various components of the seating sections 302–306 must be manufactured.

The adjustability provided by the elongated apertures 314 enables preferably about 1" of movement of each one of the seating sections 302 and 306 along frame rails 308 and 310. This further serves to enable adjustment of the seating sections 302–306 relative to each other to account for varying thicknesses of upholstery for different seating section models, different padding and/or possibly different cushion material. Preferably the seating sections 302–306 should be placed as close together as possible for aesthetic purposes and yet not be too close to impede the reclining action of any recliner seating sections being used. Placing a recliner seating section too close to an adjacent seating section could impede the smooth reclining action of the recliner while unnecessary spacing between two adjacent seating sections will detract from the aesthetic appeal of the overall sofa assembly and possibly even introduce noticeable discomfort when sitting or lying over such adjacent seating sections. Accordingly, it should be appreciated that the adjustability which elongated openings 314 introduce contributes significantly towards enabling a plurality of independent seating sections to be secured together to form an aesthetically pleasing and highly functional modular sofa assembly.

When assembled, the independent seating sections 302–306 form a sturdy, modular sofa assembly which may be moved about as a single unit if desired. Alternatively, the removable nature of frame rails 308 and 310 enables the various seating sections 302–306 to be removed if desired to facilitate transporting and handling of the sofa assembly 336. As also mentioned, the removability of frame rails 308 and 310 enables numerous varying configurations of independent seating sections to be incorporated to suit the needs of individual owners.

With reference now to FIG. 14, an alternative preferred embodiment of the mounting/stop bracket is shown comprising separate mounting and stop brackets 362 and 364, respectively. Stop bracket 364 includes an aperture 366 which is located to lie in approximate alignment over an elongated opening 368 in shoulder portion 339 of cross bar 332 when stop bracket 364 is assembled to shoulder portion 339. By incorporating stop bracket 364 as an independent component together with an elongated opening in the shoulder portion 339 of cross bar 338, a degree of adjustability is incorporated into seating section 302 for providing a positive stop for leg rest frame member 40 disclosed hereinbefore when the leg rest frame member 40 is in its retracted position and the seat section is in its upright position. The adjustability is primarily provided by the elongated opening 368 which enables the stop bracket 364 to be moved upwardly and downwardly slightly to vary the point at which the leg rest frame member 40 (not shown) makes abutting contact with a lip portion **364*a* of the stop bracket 364**.

From the above it should be apparent that the mounting apparatus 300 of the present invention serves to greatly simplify the ease with which a modular sofa may be constructed, disassembled, moved, handled and adjusted. The mounting apparatus 300 further enables independent seating sections to be quickly and easily replaced with other types of seating sections as the owner desires.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A modular sofa assembly comprising:

a plurality of independent seating sections, each said independent seating section having generally parallel front and rear frame portions;

first elongated frame rail means extending generally longitudinally parallel to said rear frame portions of each one of said independent seating sections and having a plurality of first apertures for alignably configuring said independent seating sections in said side-by-side configurations;

first securing means for cooperating with said first apertures to removably secure said fist elongated frame rail means to said rear frame portions of said independent seating sections;

second elongated frame rail means extending generally longitudinally parallel to said front frame portions of each of said independent seating sections and having a plurality of second apertures for alignably configuring said front frame portions of said independent seating sections in accordance with said side-by-side configuration; and second securing means for cooperating with said second apertures to removably secure said second elongated frame rail means to said front frame portions of each of said independent seating sections, to thereby secure each of said independent seating sections in said side-by-side configuration.

2. The mounting apparatus of claim 1, wherein said first and second pluralities of apertures each comprise a plurality of elongated apertures operable to facilitate adjustable securing of said independent seating sections to said first and second frame rail means.

3. The mounting apparatus of claim 1, wherein said first elongated frame rail mean comprises a first, elongated, L-shaped angle iron.

4. The mounting apparatus of claim 1, wherein said second elongated frame rail means comprises an elongated, L-shaped angle iron.

5. A mounting apparatus for securing a plurality of independent, modular seating sections in a side-by-side configuration to form a modular sofa assembly, wherein each said independent modular seating section includes a lower rear end portion having a longitudinally extending rear cross bar and a lower front edge portion having a longitudinally extending front cross bar, said front and rear cross bars each including a plurality of openings, said mounting apparatus comprising:

a first, elongated, L-shaped frame rail having a plurality of elongated apertures, said first frame rail extending longitudinally between said modular, independent seating sections to alignably support said rear cross bars of each of said modular, independent seating sections, in said side-by-side configuration;

a second, elongated, L-shaped frame rail having a plurality of elongated apertures, said second frame rail extending longitudinally between said modular, independent seating sections to alignably couple with said front cross bars of said modular, independent seating sections to further help secure said seating sections in said side-by-side configuration;

first connection means associated with said elongated apertures of said first elongated, L-shaped frame rail and said openings of said rear cross bars of said independent, modular seating sections for removably coupling said first frame rail with said rear cross bars;

second connection means associated with said elongated apertures of said second frame rail and said openings of said front cross bars of said seating sections for removably coupling said second frame rail with said front cross bars;

a plurality of mounting/stop brackets coupled intermediate said front cross bars of said sofa sections and said second frame rail for enabling a length of retractable travel of a leg rest assembly of one of said seating sections to be adjustably set; and whereby coupling of said first and second frame rails with said rear and front cross bars respectively of said modular independent seating sections alignably secures said seating sections in said side-by-side configuration to form said modular sofa assembly.

6. A mounting apparatus for securing three independent seating sections removably together to form a modular sofa assembly, wherein each said seating section includes a lower rear end portion and a lower front end portion, said lower rear end portions each having a rear cross bar and said lower front end portions each having a front cross bar, and wherein each of said front and rear cross bars includes a plurality of openings, said mounting apparatus comprising:

a first elongated frame rail extending longitudinally between each said seating sections and having a plurality of elongated apertures in alignment with said openings of said rear cross bars, said first elongated frame rail being operable to adjustably, alignably couple with said rear cross bars of each of said seating sections, to thereby configure said seating sections in a side-by-side configuration;

a second elongated frame rail extending longitudinally between each said seating sections and having a plurality of elongated apertures in alignment with said openings of said front cross bars of each of said seating sections, said second elongated frame rail being operable to further help adjustably, alignably configure said seating sections in said side-by-side configuration;

a plurality of mounting screws associated with said first elongated frame rail for removably securing said first elongated frame rail with said rear cross bar of each of said seating sections via said openings in each said rear cross bar and said elongated apertures of said first elongated frame rail;

a second plurality of mounting screws for removably securing said second elongated frame rail with said front cross bars via said elongated apertures in said second elongated frame rail and said openings in each of said front cross bars; and whereby said three independent seating sections are held securely in said side-by-side configuration to form said modular sofa assembly.

* * * * *

UNITED STATES PATENT AND TRADEMARK OFFICE

CERTIFICATE OF CORRECTION

PATENT NO. : 5,234,253

DATED : August 10, 1993

INVENTOR(S) : Larry P. LaPointe
Scott A. Harmon

It is certified that error appears in the above-indentified patent and that said Letters Patent is hereby corrected as shown below:

Column 3, line 30, after "tilted" insert --relative--.

Column 10, line 61, "22" should be --220--.

Column 15, line 34, claim 3, "mean" should be --means--.

Signed and Sealed this

Nineteenth Day of April, 1994

*Attest:*

*Attesting Officer*

BRUCE LEHMAN

*Commissioner of Patents and Trademarks*